US009909419B2

(12) United States Patent
Defossez et al.

(10) Patent No.: US 9,909,419 B2
(45) Date of Patent: Mar. 6, 2018

(54) STRAND, CABLE BOLT AND ITS INSTALLATION

(71) Applicants: NV BEKAERT SA, Zwevegem (BE); MINOVA INTERNATIONAL LIMITED, Holmewood (GB)

(72) Inventors: Stijn Defossez, Ertvelde (BE); David Aspinwall, Marietta, GA (US); Stephen Tadolini, St. Clairsville, OH (US); James Earl, Proctorville, OH (US)

(73) Assignees: NV BEKAERT SA, Zwevegem (BE); MINOVA INTERNATIONAL LIMITED, Holmewood (GB)

( * ) Notice: Subject to any disclaimer, the term of this patent is extended or adjusted under 35 U.S.C. 154(b) by 0 days.

(21) Appl. No.: 14/382,909

(22) PCT Filed: Mar. 1, 2013

(86) PCT No.: PCT/EP2013/054197

§ 371 (c)(1),
(2) Date: Sep. 4, 2014

(87) PCT Pub. No.: WO2013/131827

PCT Pub. Date: Sep. 12, 2013

(65) Prior Publication Data

US 2015/0043976 A1 Feb. 12, 2015

Related U.S. Application Data

(60) Provisional application No. 61/608,925, filed on Mar. 9, 2012.

(51) Int. Cl.

| | |
|---|---|
| ***E21D 21/00*** | (2006.01) |
| ***D07B 5/00*** | (2006.01) |
| ***D07B 1/06*** | (2006.01) |

(52) U.S. Cl.

CPC ..... *E21D 21/0026* (2013.01); *D07B 1/06* (2013.01); *D07B 5/005* (2013.01); *E21D 21/0006* (2013.01); *E21D 21/006* (2016.01); *E21D 21/0013* (2013.01); *D07B 1/0693* (2013.01); *D07B 2201/2002* (2013.01);

(Continued)

(58) Field of Classification Search

CPC ..... E21D 21/004; E21D 2021/006; E21D 2021/0053; E21D 21/00; E21D 20/00; E21D 21/0006; E21D 2021/0073; E02D 5/80

USPC ..... 405/259.1, 259.2, 259.3, 259.4, 259.5, 405/259.6, 262

See application file for complete search history.

(56) References Cited

U.S. PATENT DOCUMENTS 1,909,344 A * 5/1933 Green ..... F16G 11/02 191/44.1
2,799,721 A * 7/1957 Floyd, Jr. ..... B21F 15/06 174/84 C (Continued)

FOREIGN PATENT DOCUMENTS

GB 1 589 607 A 5/1981

*Primary Examiner* — Benjamin F Fiorello
*Assistant Examiner* — Edwin J Toledo-Duran
(74) *Attorney, Agent, or Firm* — Foley & Lardner LLP

(57) ABSTRACT

A strand (20) for a cable bolt (14) comprises a plurality of metallic elongated members (22, 24) twisted together. At least one of the elongated members has a corrosion resistant coating (54) and surface deformation, so as to improve the bodig efficiency and the anchorage of the strand.

18 Claims, 2 Drawing Sheets

(52) U.S. Cl.
CPC ..... *D07B 2201/2007* (2013.01); *D07B 2201/2011* (2013.01); *D07B 2205/3071* (2013.01); *D07B 2205/3092* (2013.01); *D07B 2501/2023* (2013.01)

(56) References Cited

U.S. PATENT DOCUMENTS 3,158,258 A * 11/1964 Kelday ..... B21C 3/02 72/276
3,336,744 A * 8/1967 Peene ..... D07B 1/062 57/212
3,391,531 A * 7/1968 Riggs ..... D07B 1/167 57/206
3,653,217 A * 4/1972 Williams ..... E21D 21/00 405/259.3
3,795,224 A * 3/1974 Batson ..... B05C 5/0208 118/107
4,481,996 A * 11/1984 De Bondt ..... D07B 1/0626 148/902
4,514,058 A * 4/1985 Walton ..... D07B 1/08 174/128.1
4,514,469 A * 4/1985 Loersch ..... C21D 7/06 428/553
4,645,718 A * 2/1987 Dambre ..... C25D 5/48 152/451
4,676,058 A * 6/1987 Foley ..... D07B 1/0686 57/212
5,054,146 A * 10/1991 Wiesenfeld ..... B21B 1/163 405/259.5
5,277,048 A * 1/1994 Lubas ..... B21C 9/00 72/319
5,344,062 A * 9/1994 Krengel ..... B05B 13/0618 228/147
5,475,973 A * 12/1995 Furukawa ..... D07B 1/0673 57/211
5,570,976 A * 11/1996 Fuller ..... E21D 21/0026 405/259.1
5,628,587 A * 5/1997 Lesslie ..... E21D 21/0086 405/259.1
5,716,466 A * 2/1998 Yamaoka ..... C22C 38/001 148/325
5,738,466 A * 4/1998 Ashmore ..... E21D 21/0026 405/259.1
5,749,681 A * 5/1998 Doidge ..... D07B 5/005 405/259.6
6,260,343 B1 * 7/2001 Pourladian ..... D07B 1/068 174/113 R
6,402,433 B1 * 6/2002 Gillespie ..... E21D 21/006 405/259.1
6,658,684 B2 * 12/2003 Stubler ..... D07B 1/068 14/22
6,667,110 B1 * 12/2003 Cordonnier ..... D07B 1/062 152/451
2003/0106300 A1 * 6/2003 Bruyneel ..... D07B 1/0666 57/212
2004/0025953 A1 * 2/2004 Fraser ..... F16L 9/12 138/133
2004/0161316 A1 * 8/2004 Locotos ..... E21D 20/025 411/82
2006/0096196 A1 * 5/2006 Hayes ..... E04C 5/122 52/223.13
2009/0308637 A1 * 12/2009 Amils ..... H01L 35/104 174/130
2010/0038112 A1 * 2/2010 Grether ..... D07B 1/02 174/128.1
2010/0154344 A1 6/2010 Amils et al.
2011/0027019 A1 * 2/2011 Fox ..... E21D 20/025 405/259.5
2011/0299940 A1 * 12/2011 Earl, Jr. ..... E21D 21/0026 405/259.5
2012/0097073 A1 * 4/2012 Lambrechts ..... E04C 5/012 106/644
2014/0010598 A1 * 1/2014 Craig ..... E21D 20/026 405/259.6

* cited by examiner

STRAND, CABLE BOLT AND ITS INSTALLATION

TECHNICAL FIELD

The present invention relates to a strand, a cable bolt, and an apparatus for installation in a borehole formed in a face of a civil engineering structure or mines. It also relates to the methods of fabricating such a strand, cable bolt and an apparatus for installation.

BACKGROUND ART

In civil engineering or in mine industry, the roof is often supported by bolts or cable bolts to prevent the roofs from collapsing. One known procedure as illustrated in FIG. 1 for supporting the roofs 10 is to drill a bore 12 in the roof 10 to secure a high tensile roof bolt 14 in the bore 12 in a stable position. The roof bolt 14 carries a support plate 16 engaged with the roof surface on the outer end portion of the bolt. The inserted portion of the bolt 14 is normally a steel rebar or strand 18 having an end fixed to the roof 10. In these applications rolled wires with a surface partly deformed or indented are preferred. Indeed, the formed 'rough' surface assists the bonding agent to effectively bond with the stands. Such strands are typically favorable to establish a good anchorage with their surroundings via resin, such as strands in civil engineering to obtain a satisfactory anchorage concrete and strands for mining to create a satisfactory anchorage with the rock.

A problem accompanying with the application of strands is that steel wires tend to rust when subjected to conditions, such as in a humid or acid atmosphere that enhance corrosion.

A common solution to prevent corrosion of steel wires is to provide a protective coating on the surface. In order not to adversely influence the other properties of the wire, such a coating is by preference metallic. Most preferred coatings for steels in this respect are zinc or zinc alloy that are applied through a hot dipping process onto the steel wire surface. Intermediate alloy layers are formed during the hot dipping process ensuring a good adhesion of the coating to the steel wire. Such coatings provide a sacrificial corrosion protection to the steel.

However, there are no strands in the market for this application made of steel wires having surface deformation or surface contour curvature and corrosion resistant coatings. The application of corrosion-resistant coatings on the surface of steel wires will smooth the surface and fill the deformation and thus this is detriment for the bonding efficiency and the anchorage of the strand. In this respect, there is a demand for a strand having still the desirable profiles on the surfaces and in the meantime having corrosion resistance.

DISCLOSURE OF INVENTION

It is an object of the present invention to provide a strand with a resistance to corrosion as well as with a reliable anchorage, a cable bolt and an apparatus for installation in a borehole formed in a face of a civil engineering or mining.

It is a further object of the present invention to provide a method of fabricating a strand, a cable bolt and an apparatus for installation in a borehole formed in a face of a civil engineering.

Although the strand, the cable bolt, and related installation apparatus are described as being used to reinforce and sustain roofs or faces of a civil engineering structure or of a mine, it should be understood that the present invention may be applied to support any one of the other faces of the passage or a different type of geological or civil structure, without limitation.

According to a first aspect of the invention, there is provided a strand comprising a plurality of metallic elongated members twisted together. At least one of the elongated members has a corrosion resistant coating and surface deformation.

The strand may further comprise a central metallic elongated member. The plurality of the metallic elongated members are arranged around and twisted together around the central elongated member. At least one of the outer metallic elongated members has a corrosion resistant coating and surface deformations.

In this aspect, the present invention refers to a strand made of wires which may have the following steel composition: a carbon content ranging between 0.2 wt % and 0.8 wt % (in some cases this may be more than 0.80 wt %), a manganese content from 0.3 wt % to 0.80 wt %, a silicon content ranging from 0.10 wt % to 0.50 wt %, a maximum sulphur content of 0.05 wt %, a maximum phosphorus content of 0.05 wt %, the remainder being iron and possible traces of copper, chromium, nickel, vanadium, molybdenum or boron. Alternatively, the wire of the strand may also have the following composition: a carbon content ranging between 0.8 wt % to 1.0 wt %, a manganese content from 0.5 wt % to 0.8 wt %, a silicon content ranging from 0.1 wt % to 5.0 wt %, a chromium content from 0.1 wt % to 0.5 wt %, a vanadium content from 0.02 wt % to 0.2 wt %, the remainder being iron and possible traces. As an example, the wires of the strand have a composition of 0.84 wt % carbon, 0.67 wt % manganese, 0.23 wt % silicon, 0.24 wt % chromium, 0.075 wt % vanadium, the remainder being iron and possible traces.

The corrosion resistant coating may be any coatings having corrosion resistant function. Preferably, the corrosion resistant coating is a galvanized layer. More preferably, the coating is a hot dipped zinc and/or zinc alloy.

A zinc aluminum coating has a better overall corrosion resistance than zinc. In contrast with zinc, the zinc aluminum coating is temperature resistant. Still in contrast with zinc, there is no flaking with the zinc aluminum alloy when exposed to high temperatures. A zinc aluminum coating may have an aluminum content ranging from 2 wt % to 12 wt %, e.g. ranging from 3% to 11%. A possible composition lies around the eutectoid position: aluminum about 5 wt %. The zinc alloy coating may further have a wetting agent such as lanthanum or cerium in an amount less than 0.1 wt % of the zinc alloy. The remainder of the coating is zinc and unavoidable impurities. A preferable composition contains about 10% aluminum. This increased amount of aluminum provides a better corrosion protection than the eutectoid composition with about 5 wt % of aluminum. Other elements such as silicon and magnesium may be added to the zinc aluminum coating. More preferably, with a view to optimizing the corrosion resistance, a particular good alloy comprises 2% to 10% aluminum and 0.2% to 3.0% magnesium, the remainder being zinc. An example is 5% aluminum, 0.5% magnesium and the rest being zinc.

Despite the presence of a corrosion resistant coating or layer, the surface deformations may be indentations with a depth in the range of 50 to 130 μm, preferably in the range of 80 to 100 μm. This is obtained by first galvanizing the elongated members and only thereafter subjecting them to indentations in order to avoid that the zinc or zinc alloy fills out the indentations. Since the indents have sufficient depth, the bonding agents can effectively impregnate into the strand and bond firmly the strand and the surroundings together. Thus these profiled indentations are favorable to provide good anchorage of the strands.

The strand may be in the form of seven metallic elongated members having a central metallic elongated member and six outer metallic elongated members. The six outer metallic elongated members may have an equal diameter. The diameter of the central metallic elongated member may be larger than the diameter of the outer metallic elongated members. Alternatively, the diameter of the metallic elongated members could be different from one of the other.

An another example, the strand is in the form of six metallic elongated members having a central metallic elongated member and five outer metallic elongated members. The central metallic elongated member may be the same size as or larger or smaller than the outer metallic elongated members. Preferably, the strand may be in the form of six equal diameter metallic elongated members having a central metallic elongated member and five outer metallic elongated members.

According to a second aspect of the invention, there is provided a cable bolt comprising a strand according to the first aspect of the invention, a proximal end having a fixed bolt head, and a distal end without an attachment.

According to a third aspect of the invention, there is provided an apparatus for installation in a borehole formed in a face of a civil engineering structure, comprising a cable bolt according to the second aspect of the invention located in the borehole, and a bonding agent in the borehole surrounding at least partially the strand of said cable bolt to anchor said strand therein. Preferably, the bonding agent is resin, e.g. synthetic epoxy resin.

The steel wire having zinc and/or zinc alloy coating may have good bond strength with resin as long as the adhesion of zinc and/or zinc alloy coating formed by hot dipping process to the steel wire is excellent.

According to a fourth aspect of the invention, there is provided a method of fabricating a strand. It comprises the steps of (a) preparing a plurality of metallic elongated members, (b) coating the surface of said metallic elongated members with a corrosion resistant layer, (c) deforming the surface of said metallic elongated members, and (d) arranging said metallic elongated members and twisting them together. Preferably, the said metallic elongated members are as outer elongated member around a central metallic elongated member and twisted together.

According to a preferred embodiment of the invention, said metallic elongated members are first coated with a corrosion resistant layer and are thereafter deformed. Preferably, a step of cold working of the coated metallic elongated members is performed before the surface thereof being deformed. More preferably, the surface of said metallic elongated members are deformed by rolling indentations.

According to a fifth aspect of the invention, there is provided a method of fabricating a cable bolt. It comprises the step of (a) preparing a strand according to the first respect of the invention, and (b) fixing a bolt head at the proximal end of said strand.

According to a sixth aspect of the invention, there is provided a method of installing a cable bolt in a borehole formed in a face of a civil engineering. The borehole is closed at one end and is opened at the opposite end. The method comprises (a) providing a bonding agent within the borehole adjacent the closed end thereof, and (b) inserting the cable bolt according to the second aspect of the invention into the borehole. Upon sufficient insertion of said cable bolt, the distal end of said cable bolt contacts the bonding agent and causes the bonding agent to flow around and along the length of said strand to secure the strand within the borehole.

BRIEF DESCRIPTION OF FIGURES IN THE DRAWINGS

The invention will be better understood with reference to the detailed description when considered in conjunction with the non-limiting examples and the accompanying drawings, in which.

FIGS. 6*a*, 6*b*, 6*c*, 6*d*, 6*e*, 6*f*, 6*g*, 6*h*, 6*i*, 6*j* are side views of an outer wire of the strand with some possible types of indents thereon.

MODE(S) FOR CARRYING OUT THE INVENTION

Figure 1:
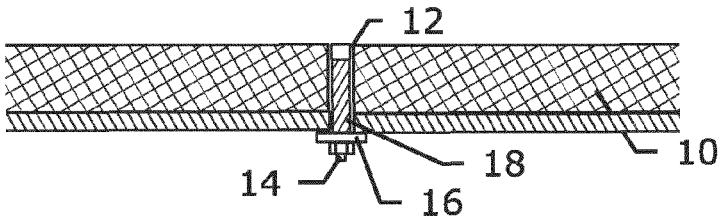
FIG. 1 is a cross-section of part of a roof illustrating one roof support bolt.
Figure 2:
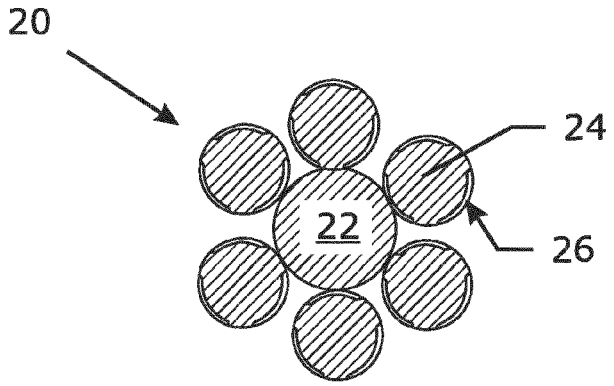
FIG. 2 is a cross-section of a strand according to the invention.

FIG. 2 is a cross section of a strand 20 according to the present application. The strand 20 includes a core wire 22 and six outer wires 24 twisted around the core wire 22. The core wire 22 may be a wire with shallow indentations. Preferably, the core wire 22 is a smooth round wire. The outer wires 24 are subjected to a surface deformation. The surface deformation are preferably indentations by rolling. The indents 26 formed on the surface of each outer wire.

As an example, as shown in FIG. 2, the strand has a 1+6 configuration, where the core wire 22 has a diameter larger than the diameter of the outer wires 24. The diameter of the core and outer wires is in the range of 1 to 20 mm. For instance, the diameter of the core wire is 5.3 mm and the diameter of the outer wire is 5.1 mm. The strand may be formed with a right or left hand helix. As an example, the lay length of the helix of the outer wire round the core wire is 200 mm giving a lay length of about 14 diameters.

Figure 3:
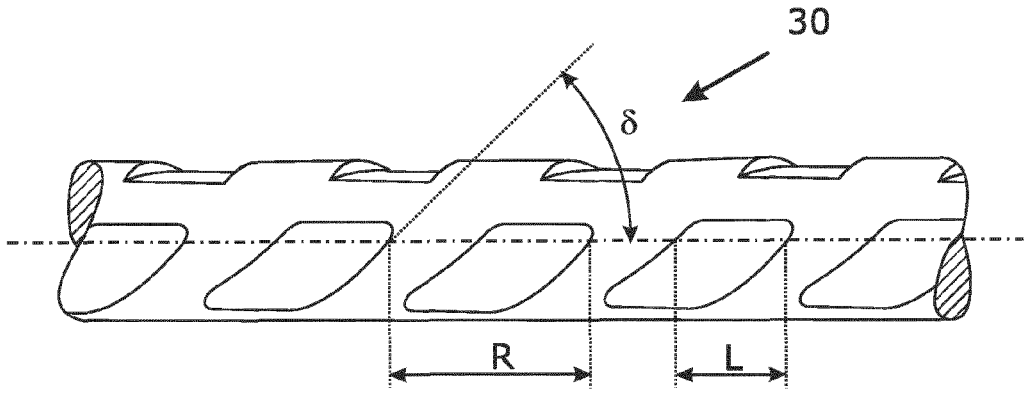
FIG. 3 is a side view of an outer wire of the strand according to the invention.

FIG. 3 is a side view 30 of the outer wire 24 in FIG. 2. As shown in FIGS. 2 and 3, the indentations are in three lines spaced uniformly around the wire and one line of indentation may be inclined in the opposite direction to the other two. Alternatively, the indentations may be in two lines. The indentation is placed in respect to the axis of the wire so that the inclined angle $\delta$ may be ranging from 0° to 180°, preferably not less than 30°, more preferably not less than 45° as shown in FIG. 3. The shape of the indentation could be parallelogram as shown in FIG. 3, and may also be ellipse. The shape and spacing of the indents are consistent.

As an example, for the outer wire 24 having a diameter of 5 mm, the spacing R of the indents is 5.50±1.10 and the length L of the indents is 3.50±0.70 as shown in FIG. 3. The depth of the indentations is in the range of 40 to 150 μm, preferably in the range of 80 to 100 μm.

In the first embodiment, the wire rod is first drawn to wires with the desirable diameter. This is followed by an indentation on the surface of the wires. Afterwards, the wires pass through a zinc and/or zinc alloy bath to form a galvanized layer on the surface of the wires.

Figure 4:
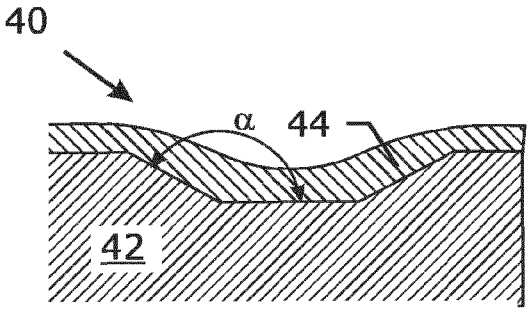
FIG. 4 is a transverse section of an outer wire for the strand according to the first embodiment of the invention.

FIG. 4 schematically shows a partial transverse section of an indented wire 40 according to the first embodiment of the invention under microscopic investigation. The steel wire rod 42 is indented having a depth ranging from 50 to 130 μm. As shown in FIG. 4, the inclined angle α is defined as the angle between the indent surface parallel to the surface of the wire and the inclined indent side which connects the parallel indent surface and wire surface. The inclined angle α is in the range of $90° < \alpha < 150°$.

After indentation, the indented wire is coated with a zinc and/or zinc alloy coating 44. The thickness of the coating is between 10 to 200 $g/m^2$, preferably 30 to 150 $g/m^2$, most preferably 50 to 80 $g/m^2$. It is found that after the formation of coatings, the profile of the indents may be changed, the α angle become wider or difficult to be defined. The coating filled in the indentation and the surface of the wire became smooth. While the thicker the coating, the smoother the surface of the wire.

Figure 5:
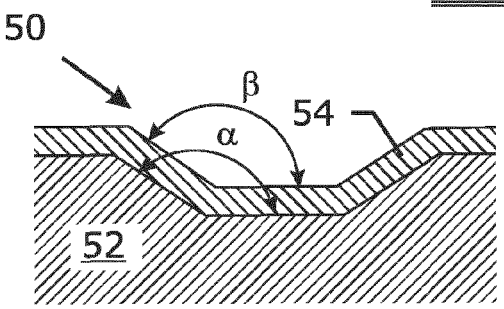
FIG. 5 is a transverse section of an outer wire for the strand according to the second embodiment of the invention.

FIG. 5 schematically shows a partial transverse section of an indented wire 50 according to the second embodiment of the invention under microscopic investigation. In the second embodiment, the wire rod 52 is first coated with zinc and/or zinc alloy 54. The galvanized wire rod is then redrawn to the wires with a final desirable diameter. Alternatively, the wire rod is first redrawn to the a desirable diameter and followed by a galvanizing process to form corrosion resistant coating. Thereafter, the wires 52 are indented by rolling.

Under the microscopic investigation as shown in FIG. 5, the galvanized coating 54 is perfectly conformal to the profile of the indent. This is characterized by the inclined angle α of the indents has a similar degree to the inclined angle β of the coating. As shown in FIG. 5, the inclined angle β of the coating is defined as the angle between the coating part parallel to the surface of the indents and the coating part parallel to the inclined side of the indents. As measured by microscopy, when the α angle is in the range of $90° < \alpha < 150°$, the β angle is well defined and in a similar range of the α angle. The deviation of the α angle to the α angle is within 20°, preferably within 10° and more preferably within 5°. For example, when the α angle is 135°, the β angle is in the range of $130° < \beta < 140°$.

In this embodiment, the depth of the indents is ranging from 50 to 130 μm. The galvanized coating 54 have a similar thickness as in the first embodiment.

Cable bolt is based on a length of strand typically having a length of about 2 to 10 meters. The proximal end portion of the bolt carries a roof support plate which is held against the roof by a head. Upon sufficient insertion of the cable bolt, the distal end of said cable bolt contacts the bonding agent, such as an uncured resin enclosed in a bag and separated from a catalyst which is provided in the inner part of the borehole. This causes the bonding agent to flow around and along the length of the strand to secure the strand within the borehole.

Figure 6A:
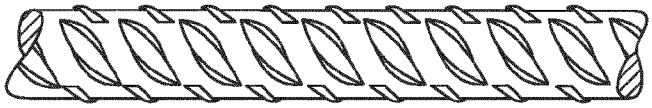
Figure 6B:
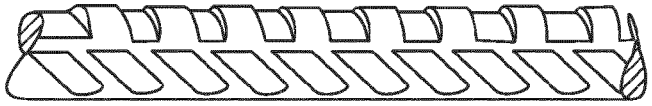
Figure 6C:
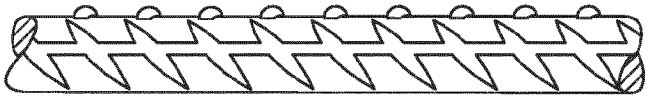
Figure 6D:
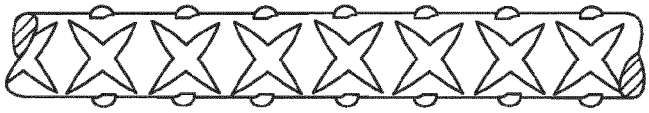
Figure 6E:
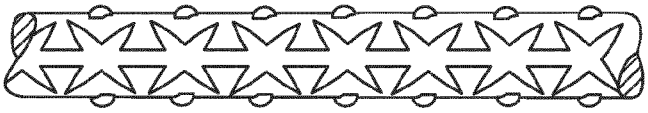
Figure 6F:
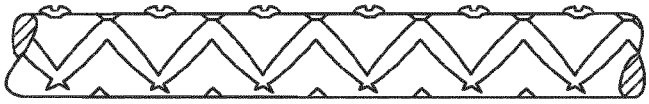
Figure 6G:
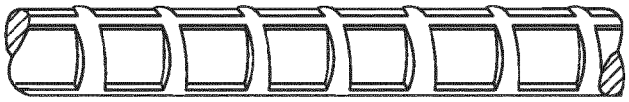
Figure 6H:
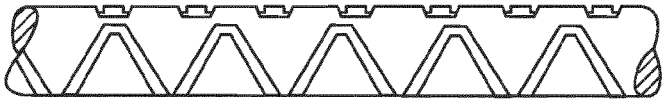
Figure 6I:
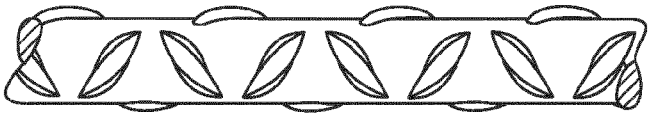
Figure 6J:
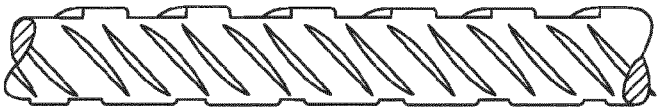

The invention illustratively described herein may suitably be practiced in the absence of any element or elements, limitation or limitations, not specifically disclosed herein. Thus, for example, the type or pattern of indents may be varied or modified as schematically shown in FIG. 6. The indents may have an oriented elongated shape with two attached crescent parts at two sides (FIG. 6*a*) and may have an oriented parallelogram shape (FIG. 6*b*). The indents may have an oriented elongated shape and the indented shapes are connected together (FIG. 6*c*). The indents may have a star shape (FIG. 6*d*) or a linked-up star shape (FIG. 6*e*). The indents may have a zigzag shape (FIG. 6*f*, FIG. 6*h*), a square shape (FIG. 6*g*). The indents may have an elongated shape with two attached crescent parts at two sides and the elongated shapes have different orientation (FIG. 6*i*). The indents may also have narrow elongated shapes having equal orientation (FIG. 6*j*).

Therefore, it should be understood that although the present invention has been specifically disclosed by preferred embodiments and optional features, modification and variation of the inventions embodied herein disclosed may be resorted to by those skilled in the art, and that such modifications and variations are considered to be within the scope of this invention.

LIST OF REFERENCES

10 roof
12 bore
14 roof bolt
16 support plate
18 steel rebar or strand
20 strand
22 core wire
24 outer wire
26 indent
30 side view of an outer wire
40 indented wire
42 steel wire rode
44 zinc and/or zinc alloy coating
50 indented wire
52 steel wire rode
54 zinc and/or zinc alloy coating

The invention claimed is:

1. A method of fabricating a strand with improved corrosion resistance and a reliable anchorage, comprising the steps of:

(a) preparing a plurality of outer metallic elongated members;

(b) coating a surface of the outer metallic elongated members with a corrosion resistant layer having a thickness in a range of 10 $g/m^2$ to 200 $g/m^2$;

(c) cold working the coated outer metallic elongated members to their final dimensions;

(d) deforming the surface of the coated outer metallic elongated members to form indentations having a depth in a range of 80 μm to 130 μm; and (e) arranging the coated outer metallic elongated members and twisting them together with a central metallic elongated member, wherein step (b) and step (c) are performed prior to step (d) such that a profile of the corrosion resistant layer is conformal to a profile of the indentations, and the central metallic elongated member is a smooth round wire, and wherein the strand forms a cable bolt configured to be inserted in a borehole of a mine roof.

2. The method of fabricating a strand according to claim 1, wherein in step (d) the surface of the coated outer metallic elongated members are deformed by rolling indentation.

3. The method of fabricating a strand according to claim 1, wherein in step (b) the thickness of the corrosion resistant layer is in a range of 30 $g/m^2$ to 150 $g/m^2$.

4. The method of fabricating a strand according to claim 1, wherein in step (b) the thickness of the corrosion resistant layer is in a range of 50 $g/m^2$ to 80 $g/m^2$.

5. The method of fabricating a strand according to claim 1, wherein the cable bolt is formed by fixing a bolt head at a proximal end of the strand.

6. The method of fabricating a strand according to claim 1, wherein the strand comprises six coated outer metallic elongated members and one central metallic elongated member.

7. The method of fabricating a strand according to claim 1, wherein the strand comprises five coated outer metallic elongated members and one central metallic elongated member.

8. The method of fabricating a strand according to claim 1, wherein at least one outer metallic elongated member is made of steel comprising carbon, manganese, silicon, sulphur, phosphorous and iron.

9. The method of fabricating a strand according to claim 1, wherein at least one outer metallic elongated member is made of steel comprising a carbon content in a range of 0.2 wt % to 0.8 wt %, a manganese content in a range of 0.3 wt % to 0.8 wt %, a silicon content in a range of 0.1 wt % to 0.5 wt %, a maximum sulphur content of 0.05 wt %, a maximum phosphorous content of 0.05 wt %, and iron.

10. The method of fabricating a strand according to claim 8, wherein the steel comprising the at least one outer metallic elongated member further comprises traces of copper, chromium, nickel, vanadium, molybdenum or boron.

11. The method of fabricating a strand according to claim 1, wherein at least one outer metallic elongated member is made of steel comprising carbon, manganese, silicon, chromium, vanadium and iron.

12. The method of fabricating a strand according to claim 1, wherein at least one outer metallic elongated member is made of steel comprising a carbon content in a range of 0.8 wt % to 1.0 wt %, a manganese content in a range of 0.5 wt % to 0.8 wt %, a silicon content in a range of 0.1 wt % to 5.0 wt %, a chromium content in a range of 0.1 wt % to 0.5 wt %, a vanadium content in a range of 0.02 wt % to 0.2 wt %, and iron.

13. The method of fabricating a strand according to claim 1, wherein at least one outer metallic elongated member is made of steel comprising 0.84 wt % carbon, 0.67 wt % manganese, 0.23 wt % silicon, 0.24 wt % chromium, 0.075 wt % vanadium, and iron.

14. The method of fabricating a strand according to claim 1, wherein the corrosion resistant layer comprises zinc or a zinc alloy.

15. The method of fabricating a strand according to claim 1, wherein the corrosion resistant layer comprises a zinc aluminum coating.

16. The method of fabricating a strand according to claim 15, wherein an aluminum content of the zinc aluminum coating is in a range of 2 wt % to 12 wt %.

17. The method of fabricating a strand according to claim 1, wherein the corrosion resistant layer comprises aluminum, magnesium and zinc.

18. The method of fabricating a strand according to claim 17, wherein the corrosion resistant layer comprises 2% to 10% aluminum, 0.2% to 3% magnesium and a remainder of zinc.

* * * * *